United States Patent [19]

Fournier et al.

[11] Patent Number: 4,825,943

[45] Date of Patent: May 2, 1989

[54] DEVICE FOR FIXING LOOPS IN A COMPONENT OF A HEAT EXCHANGER CONSTITUTED BY TUBES IN WHICH A FLUID FLOWS

[75] Inventors: Jean Fournier, Rochefort en Yvelines; Paul Meynard, Verrieres le Buisson, both of France

[73] Assignee: Stein Industrie, Velizy Villacoublay, France

[21] Appl. No.: 149,268

[22] Filed: Jan. 28, 1988

[30] Foreign Application Priority Data

Jan. 28, 1987 [FR] France ..... 87 01007

[51] Int. Cl.[4] ..... F28D 7/02

[52] U.S. Cl. ..... 165/162; 165/172; 122/510

[58] Field of Search ..... 165/172, 162; 122/510, 122/511, 512

[56] References Cited

U.S. PATENT DOCUMENTS

| | | | |
|---|---|---|---|
| 2,477,950 | 8/1949 | Bailey | 122/510 |
| 3,228,379 | 1/1966 | Schaloske | 122/510 |
| 4,550,777 | 11/1985 | Fournier et al. | 165/172 |

FOREIGN PATENT DOCUMENTS

| | | | |
|---|---|---|---|
| 0143432 | 6/1985 | European Pat. Off. . | |
| 2011621 | 11/1971 | Fed. Rep. of Germany . | |
| 898090 | 4/1945 | France . | |
| 501202 | 2/1939 | United Kingdom | 122/510 |
| 942036 | 11/1963 | United Kingdom . | |
| 1094253 | 11/1967 | United Kingdom . | |
| 1117813 | 6/1968 | United Kingdom . | |

*Primary Examiner*—James C. Yeung

*Attorney, Agent, or Firm*—Sughrue, Mion, Zinn, Macpeak & Seas

[57] ABSTRACT

A device for fixing loops in a component (1) of a heat exchanger constituted by tubes (10) in which a fluid flows, the loops being situated in the plane of the heat exchanger and being formed by bends and by mutually parallel vertical lengths (11), at least one tube forms an additional loop (12, 14) leaving the plane of the heat exchanger component and surrounding the vertical lengths (11), the device being characterized in that a notched flat (2) is installed level with the additional loop, said flat being provided with semicircular openings each of which receives a vertical length.

4 Claims, 3 Drawing Sheets

DEVICE FOR FIXING LOOPS IN A COMPONENT OF A HEAT EXCHANGER CONSTITUTED BY TUBES IN WHICH A FLUID FLOWS

The present invention relates to a device for fixing loops in a component of a heat exchanger constituted by tubes in which a fluid flows, the loops being situated in the plane of the heat exchanger and being formed by bends and mutually parallel vertical lengths, with at least one tube forming an addtional loop leaving the plane of the heat exchanger component and surrounding the vertical lengths.

BACKGROUND OF THE INVENTION

The tubes of such a heat exchanger component must be fixed together to ensure that said heat exchanger component is sufficiently rigid and to maintain the tubes equidistant from one another and in the plane of the heat exchanger.

In order to provide these three functions, manufacturers make use, in a manner known per se, of link parts which are applied against the loops and manually welded thereto, and this is done at several levels.

The use of manual welding techniques gives rise to high manufacturing costs, to risks of cracking at the welds, and to the necessity of deforming each tube in a heat exchanger having spaced-apart tubes in order to bring the two lengths of tube adjacent to the link part closer together in order to cool said part and thus avoid oxidation thereof.

Patent document GB-A-No. 942036 describes a panel of horizontal heat exchanger tubes in a vertical plane, including an additional loop surrounding the tubes of the panel. However, the tubes of the panel are not maintained in fixed relative positions and can therefore still be subjected to deformation due to differential expansion.

The present invention seeks to provide a device for fixing together the loops in a heat exchanger component which ensures that the tubes are held relative to one another in substantially fixed relative positions, while still being cheap to manufacture.

SUMMARY OF THE INVENTION

The present invention provides a device for fixing loops in a component of a heat exchanger constituted by tubes in which a fluid flows, the loops being situated in the plane of the heat exchanger and being formed by bends and by mutually parallel vertical lengths, at least one tube forming an additional loop leaving the plane of the heat exchanger component and surrounding the vertical lengths, the device including a notched flat is installed level with the additional loop, said flat being provided with semicircular openings each of which receives a vertical length, and said at least one tube being interrupted to form an additional loop which is complete and without fluid flow discontinuity.

It preferably includes at least one of the following features:

at least one tab which is welded to one of the vertical lengths;

two lengths which form two humps surrounding an additional loop in order to keep it pressed against the other vertical lengths; and two adjacent vertical lengths which form a ring therebetween without fluid flow discontinuity, said ring supporting an additional loop constituted by two half-loops each pressing against one side of the vertical lengths.

BRIEF DESCRIPTION OF THE DRAWINGS

Embodiments of the invention are described by way of example with reference to the accompanying drawings, in which.

MORE DETAILED DESCRIPTION

Figure 1:
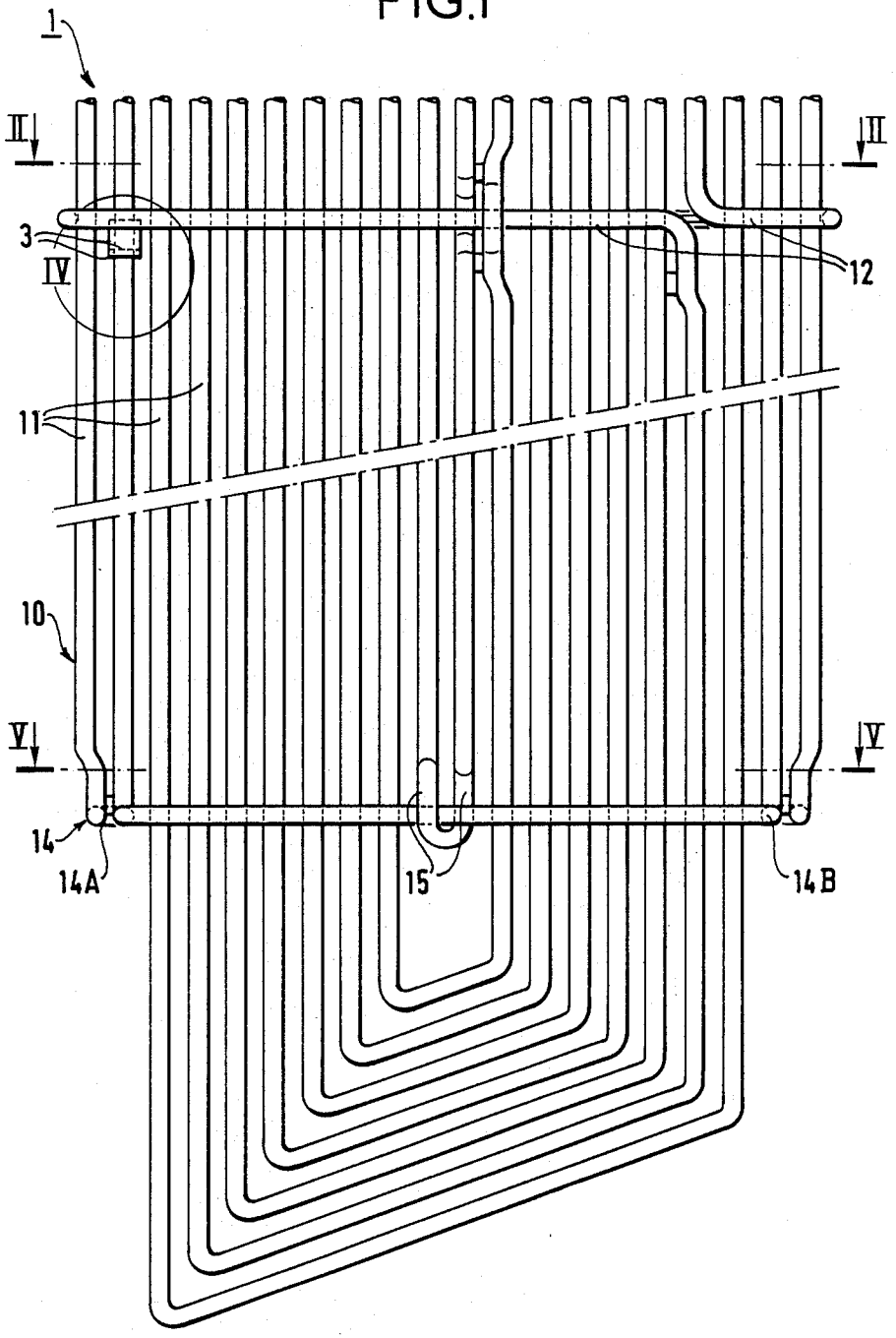
FIG. 1 is a fragmentary view of a heat exchanger component.

FIG. 1 shows that the heat exchanger component is constituted by at least one tube 10 through which a fluid flows continuously between an inlet and an outlet. This tube has multiple loops constituted by bends and straight vertical tube lengths 11, these vertical tube lengths are mutually parallel and are situated in the plane of the heat exchanger component and form a planar array of vertical tube lengths. FIG. 1 shows an additional horizontal loop 12 which is more clearly visible in FIG. 2 defined by straight horizontal tube lengths integrally joined by reverse bends at opposite ends thereof and which surrounds the vertical tube lengths 11, it also shows a loop 14 constituted by two horizontal half-loops primarily of straight horizontal tube lengths and surrounding the vertical tube and surrounding the a horizontal loop 14 contributed by lengths 11, with said half-loops being more clearly visible in FIG. 5.

Figure 4:
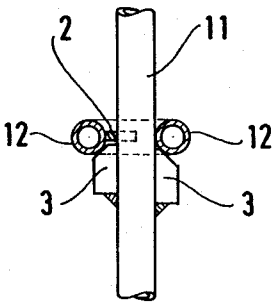
FIG. 4 shows a detail IV of FIG. 1 as applied to the first embodiment.

FIG. 1 also shows the location of a support tab 3, said tab being shown in FIG. 4.

Figure 2:
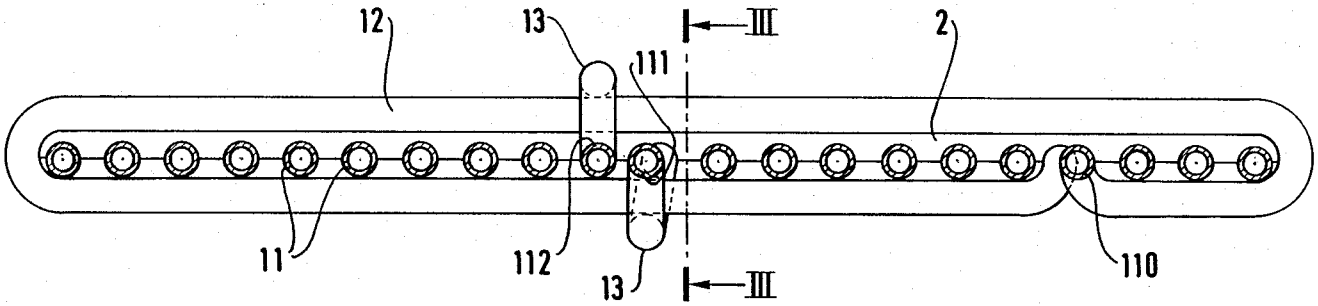
FIG. 2 is a section on II of FIG. 1 showing a first embodiment of the device.

FIG. 2 is a section showing the vertical tube lengths 11 surrounded by the additional horizontal loop 12. A notched flat 2 provided with semicircular openings or notches, each receiving one of the vertical tube lengths 11 is installed level with the additional loop 12, extending along one horizontal tube length and facing the other horizontal tube length, but being spaced therefrom. This notched flat ensures that the lengths are equidistant and, together with the additional loop, participates in making the component rigid.

The additional loop 12 leaves a length 110, takes a turn around the lengths, and returns to its starting point in order to reconstitute the length 110.

Figure 3:
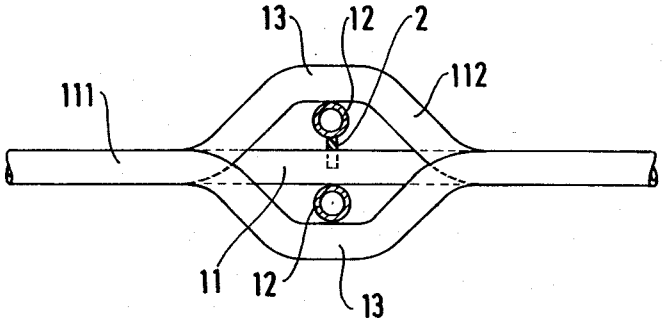
FIG. 3 is a fragmentary section on III of FIG. 2.

This loop 12 is supported by two humps 13 each formed from a corresponding adjacent vertical tube length 111 and 112, bent outwardly in opposite directions and bent around and in contact with the outside of respective horizontal tube lengths of the additional loop 12 and more clearly visible in FIG. 3.

FIG. 3, which is a section on III of FIG. 2 shows the additional loop 12, the notched flat 2, and the humps 13.

FIG. 4 shows two tabs 3 welded on a vertical tube length 11, said tabs being located along an additional horizontal loop 12 and below that loop in order to support it, as shown in FIG. 1.

Figure 5:
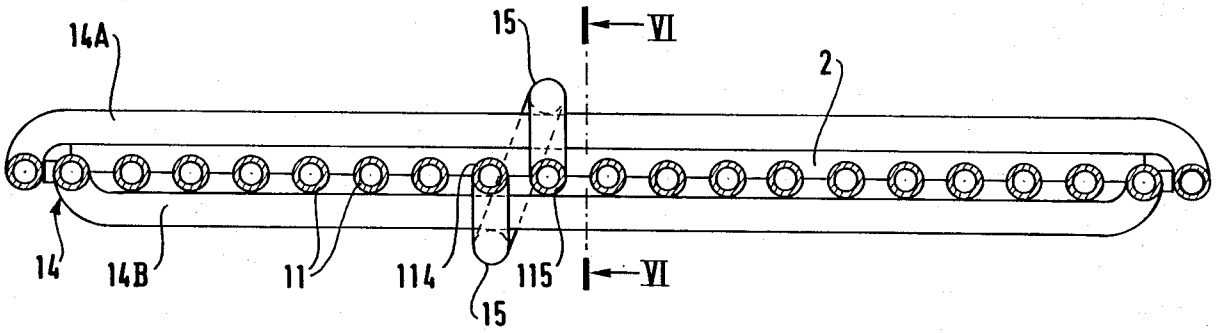
FIG. 5 is a section on V of FIG. 1 showing the second embodiment.

FIG. 5 is a section showing the vertical lengths 11 surrounded by the additional loop 14 constituted by two horizontal half-loops 14A and 14B.

Figure 6:
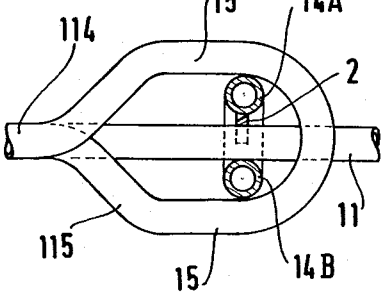
FIG. 6 is a fragmentary section on VI of FIG. 5.

The half-loop 14A is formed without flow discontinuity between the two end vertical tube lengths 11, and the half-loop 14B is formed without fluid flow discontinuity between the two penultimate vertical tube lengths. These two half-loops 14A and 14B are supported by a ring 15 made at the end of two adjacent vertical tube lengths 114 and 115, said ring being clearly visible in FIG. 6.

Naturally, the two half-loops 14A and 14B could be supported by two horizontal humps equivalent to the humps 13 of FIG. 3.

We claim:

1. A heat exchanger component comprising:

a plurality of mutually parallel heat exchange straight vertical tube lengths in which a fluid flows and which form a vertical tube length array, integral bends connecting said vertical tube lengths in the plane of the vertical tube length array thereby defining vertical loops with each bend maintaining fluid flow continuously between two given vertical tube lengths, at least one of said vertical tube lengths vertically interrupted by at least one integral, horizontal tube length extending transversely across a face of said vertical tube length array, outside of the plane of said vertical tube length array and forming at least a part of a complete horizontal additional loop surrounding said vertical tube length array with parallel straight horizontal tube lengths on opposite sides of said array of vertical tube lengths without flow discontinuity through said one vertical tube length whereby said complete additional horizontal loop maintains the vertical tube lengths relative to one another in substantially fixed position, and a flat extending horizontally along the exterior of one said parallel straight horizontal tube lengths of said complete additional horizontal loop on the side facing said straight vertical tube length, and having a plurality of notches within an edge thereof facing and receiving respectively said vertical tube lengths of said array for maintaining the vertical tube lengths spaced relative to one another and in substantially fixed position.

2. A heat exchanger component according to claim 1, further including at least one tab welded to one of the vertical lengths underlying said additional horizontal loop, and supporting said horizontal loop about said array of vertical tube lengths.

3. A heat exchanger component according to claim 1, wherein two adjacent vertical tube lengths are deformed outwardly in opposite directions and pressed about the exterior of respective horizontal tube lengths of said additional loop to maintain said notched flat in contact with the vertical tube lengths extending through the notches thereof to maintain the tube vertical lengths in said substantially fixed positions.

4. A heat exchanger component according to claim 1, wherein two adjacent vertical tube lengths are integrally joined by a ring therebetween with fluid flow continuity therebetween, wherein said additional loop is formed by two half-loops each having a straight horizontal tube length, and wherein said straight horizontal tube length of one of said half-loops has a non notched edge of said flat fixably mounted thereto with said ring pressing said notched edge of said flat against one side of said vertical tube lengths and the other side of said vertical tube lengths against the straight horizontal tube length of said other of said two half-loops.

* * * * *